United States Patent [19]

Breese

[11] Patent Number: 4,751,836

[45] Date of Patent: Jun. 21, 1988

[54] PIPE END CONDITIONER AND METHOD

[75] Inventor: Peter Breese, Ojai, Calif.

[73] Assignee: Vetco Gray Inc., Houston, Tex.

[21] Appl. No.: 131,236

[22] Filed: Dec. 7, 1987

Related U.S. Application Data

[63] Continuation of Ser. No. 882,868, Jul. 7, 1986, abandoned.

[51] Int. Cl.[4] ..... B21D 26/02

[52] U.S. Cl. ..... 72/62; 72/61; 72/56; 72/370; 29/421 R

[58] Field of Search ..... 72/56, 58, 60, 62, 61, 72/370, 317; 29/421 R; 10/87

[56] References Cited

U.S. PATENT DOCUMENTS

| | | | |
|---|---|---|---|
| 3,486,703 | 12/1969 | Sorlie | 72/61 |
| 3,487,668 | 1/1970 | Fuchs, Jr. | 72/61 |
| 4,622,732 | 11/1986 | Broderick | 29/421 R |

FOREIGN PATENT DOCUMENTS

| | | | |
|---|---|---|---|
| 2711649 | 10/1977 | Fed. Rep. of Germany | 72/62 |
| 191458 | 1/1967 | U.S.S.R. | 72/62 |

*Primary Examiner*—David Jones

*Attorney, Agent, or Firm*—Joseph R. Dwyer

[57] ABSTRACT

An apparatus and method including a swaging die (10) with an internal cone-shaped bore section which will swage a pipe (14) forced into such die and form the cone section (30) on the pipe. Within the swaging die (10) is an insert/ejector plate (32) of a diameter to fit within the bore of the pipe (14) and wherein high pressure fluid directed through the insert/ejector plate (32) to the inside wall of the pipe (14) expands the pipe thus forming a longer, more acceptable, cone section (30) capable of providing more thread length for later threading operation. After the expansion pressure is relieved, the insert/ejector plate (32) is used to force the pipe (14) out of the swaging die (14).

7 Claims, 1 Drawing Sheet

PIPE END CONDITIONER AND METHOD

This is a continuation of application Ser. No. 882,868, filed 07/07/86, now abandoned.

BACKGROUND OF INVENTION

This invention relates, in general, to an apparatus and method for processing large diameter pipes, such as used in drilling and production of subsea oil and gas wells, and in particular, this invention is directed to an apparatus and method for cold forming (swaging) the ends of such large diameter pipes into tapered (cone shaped) sections as one step in forming of pin connectors.

Pin connectors to form a joint between large diameter pipes are used extensively in offshore drilling and production of subsea oil and gas wells. One use of such pipes is to connect them end-to-end to form a casing connection extending from a vessel on the surface of the water to the ocean floor. To form the connection, various taper angles and thread forms are used.

Such large diameter pipes typically range from 16" to 26" in diameter, have a wall thickness ranging from 0.438" to 1.00" and are typically over 40 ft. in length.

To form the pin on the ends of such pipes, the pipe ends are first provided with conically shaped sections and then these sections are provided with threads of any suitable thread form. However, the threads on such pipes can be severely restricted in scope by the allowed outer diameter tolerance, out-of-roundness, and the wall thickness tolerances. These result in lack of adequate thread length, lack of thread nose thickness, or both. Thus, current threaded pipe designs either compromise on the strength of the threads or require specially selected pipes.

It is an object of this invention to provide an apparatus and method which provides conical sections of adequate thickness and length for suitable threads so that there is no need to compromise the thread design or to be restricted in the selection of pipes to use.

SUMMARY OF THE INVENTION

The apparatus and method which meets the foregoing object comprises, a swaging die, essentially bell shaped in cross section, with an internal blind bore which will swage a pipe forced into such die and form the cone section on the pipe. Within the swaging die is an insert/ejector plate of a diameter to fit within the bore of the pipe and wherein high pressure fluid directed through the insert/ejector plate to the inside wall of the pipe expands the pipe thus forming a longer, more acceptable, cone section capable of providing more thread length for later threading operation. After the expansion pressure is relieved, the insert/ejector plate is used to force the pipe out of the swaging die.

Other advantages of the apparatus and method of this invention will become apparent to those skilled in the art after a review of the drawings and a more-detailed description of the invention hereinafter.

DETAILED DESCRIPTION

Figure 1:
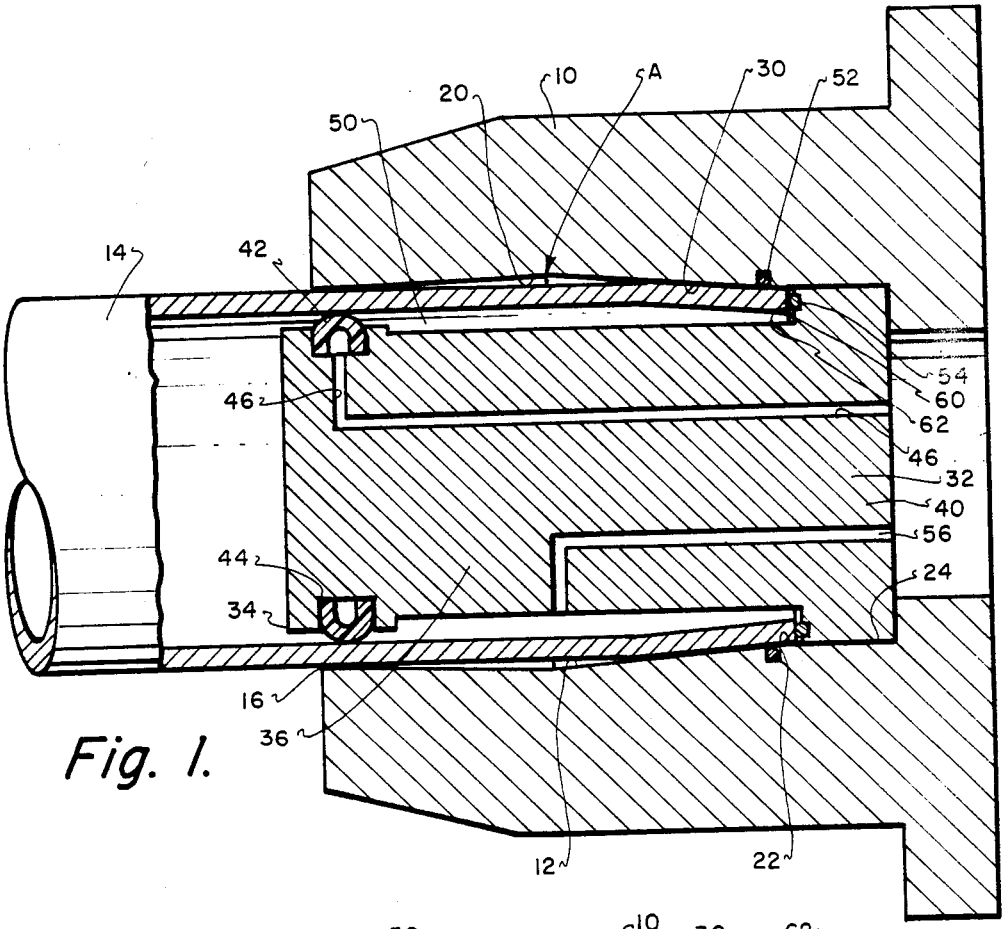
FIG. 1 is a cross-sectional view showing the pipe inserted a maximum amount into a swaging die but before expansion pressure is communicated to the inside of the pipe.

It is to be understood that while the formation of a cone section on only one end of a pipe is shown, normally both ends of the pipe are formed at the same time. Thus in the drawings, there is shown a cylindrical swaging die 10 having an axial bore 12 for the reception of a pipe, such as 14, to be fabricated. The diameter of the mouth 16 of the bore 12 is sufficient for maximum tolerance of the outer diameter of the pipe 14. The bore 12 first gradually tapers from the mouth 16 to a slightly larger diameter than the mouth about midway of the length of the bore, as at 20, then gradually tapers from this midway point to a much smaller diameter than the mouth 16 near the end 22 of the bore. The bore then becomes cylindrical in area 24. Thus formed, the swaging die, when the pipe end is forced onto the bore 12, will swage the pipe end into a tapered cone section as at 30.

Within the bore 12 of the swaging die is a pressure insert/ejector plate 32. This insert/ejector plate 32 is cylindrical with a first section 34 of a diameter less than the inside diameter of the pipe, a second or midsection 36 extending over a major portion of the length of the insert/ejector plate. Midsection 36 has a diameter less than the diameter of the first section and terminates in a third section 40 of a larger diameter than the diameter of the first two sections and larger than the outer diameter of the pipe when the cone section 30 has been formed to fit snugly within the bore of the swaging die in area 24.

The insert/ejector plate 32 is provided with pressure-responsive sealing means in the form of an elastomeric sealing ring 42, U-shaped in cross section, positioned in a peripheral groove 44 in the front section 34 and adapted to engage the inner wall of the pipe. Both groove 44 and sealing ring 42 are located near the mouth 16 of the bore. This sealing means is in communication with a source of fluid under pressure via passage 46 for expanding the sealing ring 42 to sealing engaging the inner wall of the pipe. When so expanded, the second or midsection 36 forms, with the inner wall of the pipe, a pressure chamber 50. The chamber 50 is also sealed by O-ring seals 52, 54 located in the bore of the swaging die near the end of the pipe in suitable grooves in the swaging die 10 and the insert/ejector plate 32. Wall 60 of the insert/ejector plate 32 is canted to accommodate those pipes having a preformed taper 62, and for those pipes without such a preformed taper, the wall 60 would be normal to the axis of the pipe.

Figure 2:
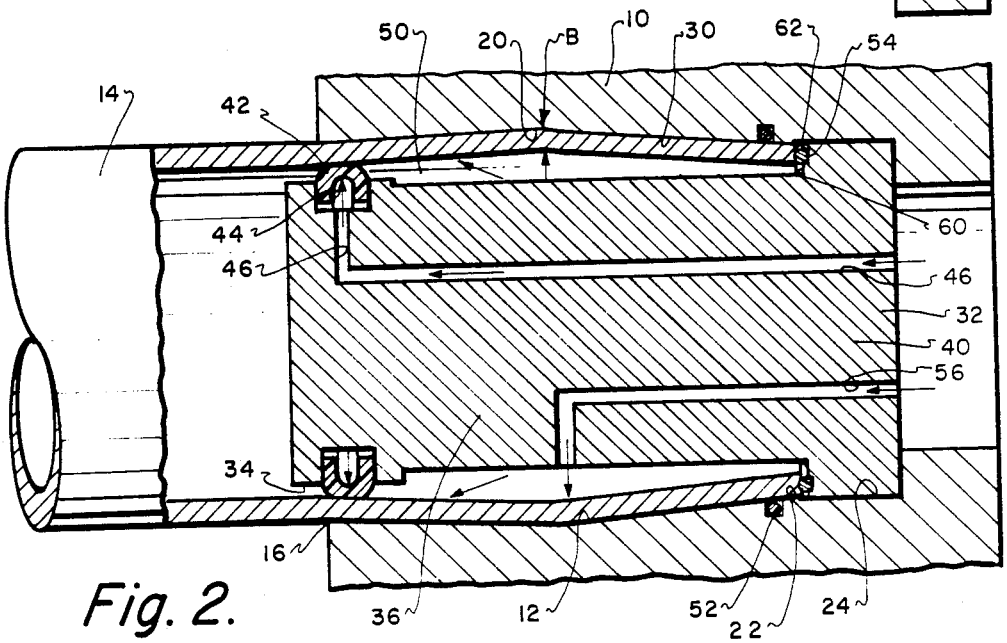
FIG. 2 is a cross-sectional view showing the pipe under expansion for providing an adequate cone section on the pipe.

The insert/ejector plate 32 is also provided with a second fluid communication passage 56 which is connectible to second source of high pressure when communicated to chamber 50 expands the pipe to engage the inner side wall of the bore of the swaging die in the area near the midpoint 20. This pressure overexpands the pipe which forces the pipe diameter outward lengthening critical cone section thus ensuring a pin cone section of sufficient thread length. The pressure for pipe expansion depends on the material of the pipe, pipe size, and wall thickness and can vary from 5,000 to 15,000 psi. The pin cone section is lengthened from about point A in FIG. 1 to point B in FIG. 2.

After the expansion of the pipe, the pressure in the chamber is first reduced and then the pressure on the seal ring 42.

After both pressures have been relieved, the insert/ejector 32 is forced by fluid pressure, such as a hydraulic ram, axially through the die thus ejecting the pipe from the swaging die. Notwithstanding the fact that the pipe wall elasticity has been exceeded to from the extended cone section, the side wall of the pipe will retract a little making the pipe ejection easier.

I claim:

1. A pipe end conditioner for conically forming the end of a large diameter pipe in preparation for threading the pipe end comprising, a swaging die of a length less than the length of said pipe and provided with a conical bore section for forming a cone section on the end of said pipe, when said pipe end is inserted therein, a removable insert/ejector plate in said swaging die and positionable within said pipe end by insertion into the pipe at the end being formed, means forming a pressure chamber with the pipe inner wall and insert/ejector plate, and means for communicating fluid under pressure through said insert/ejector plate to said chamber to urge and expand said pipe against the inner wall of said swaging die to lengthen the cone section formed on said pipe initially by said swaging die when said pipe was inserted therein.

2. The pipe end conditioner as claimed in claim 1 wherein said means for forming said pressure chamber comprise sealing means responsive to fluid pressure so as to engage the pipe inner wall and means within said insert/ejector plate for communicating fluid under pressure to said seal means.

3. A pipe conditioner for conically forming the end of a large diameter pipe in preparation for threading the pipe and comprising, a swaging die of a length less than the length of said pipe and provided with a conical bore section for initially forming a cone section on the end of said pipe when said pipe end is inserted therein, a removable insert/ejector plate in said swaging die and positionable within said pipe end by insertion into the pipe end being formed, sealing means on said insert/ejector plate for sealingly engaging the inner wall of said pipe in response to fluid pressure and forming a pressure chamber with said pipe wall and said insert/ejector plate, means in said insert/ejector plate for communicating fluid under pressure to said sealing means, and means in said insert/ejector plate for communicating fluid under pressure to said chamber to urge and expand said pipe against the inner wall of said swaging die to lengthen the cone section initially formed on said pipe by said swaging die.

4. The pipe conditioner as claimed in claim 3 wherein said insert/ejector plate includes means engaging said pipe end and is subjected to an external force to eject said insert/ejector plate and said pipe end from said conditioner when said pipe end has been conically formed.

5. The pipe end conditioner as claimed in claim 3 wherein said swaging die has a bore mouth for reception of said pipe end, said axial bore first gradually tapering radially outwardly from said mouth to about midway of the length of said bore and then secondly gradually tapering radially inwardly from said midway point to the end of said bore, said latter taper forming said initially formed conical section, and said insert/ejector plate having a first section of lesser diameter than the inside diameter of said pipe, a second section of lesser diameter than said first section and terminating in a third section of a diameter larger than the other two sections and larger than the outer diameter of said pipe to, in part, form said pressure chamber such that when pressure is communicated to said pressure chamber to expand said pipe in the area of said first and second tapers, said initially formed conical section is lengthened, said third section forming means by which an external force on said insert/ejector plate removes said insert/ejector plate and said pipe from said conditioner.

6. A method of forming a conical taper on the end of a large diameter pipe comprising the steps of:

urging the end of said pipe within a conical bore surface of a swaging die to initially form a cone section on the end of said pipe and inserting an insert/ejector plate in the end of said pipe being formed, forming a seal with said pipe end by communicating pressure to a seal which engages the inner wall of said pipe and thus forming a pressure chamber between said insert/ejector plate and the inner wall, communicating pressure to said chamber from within said insert/ejector plate to expand said pipe against the bore of said swaging die to increase the length of said initially formed cone section.

7. The method as claimed in claim 6 further including the steps of relieving the pressure in said seal and said chamber and removing the pipe from said swaging die.

* * * * *